US007300554B2

(12) United States Patent
LaFond et al.

(10) Patent No.: US 7,300,554 B2
(45) Date of Patent: Nov. 27, 2007

(54) TEXTURED SURFACE OF A TISSUE FORMING FABRIC TO GENERATE BULK, CROSS DIRECTIONAL TENSILE, ABSORBENCY, AND SOFTNESS IN A SHEET OF PAPER

(75) Inventors: John J. LaFond, Appleton, WI (US); Cynthia Rose Mathe, Oshkosh, WI (US); Jeffrey Joseph Collegnon, Combined Locks, WI (US); Bruce Stowe, Neenah, WI (US)

(73) Assignee: Albany International Corp., Albany, NY (US)

( * ) Notice: Subject to any disclaimer, the term of this patent is extended or adjusted under 35 U.S.C. 154(b) by 416 days.

(21) Appl. No.: 10/659,962

(22) Filed: Sep. 11, 2003

(65) Prior Publication Data

US 2005/0067039 A1 Mar. 31, 2005

(51) Int. Cl.
*D21F 1/10* (2006.01)
*D03D 3/04* (2006.01)

(52) U.S. Cl. ..... 162/348; 162/117; 162/903; 139/383 A; 139/425 A

(58) Field of Classification Search ..... 162/116, 162/117, 348, 358.1, 358.2, 900–904, 361, 162/362; 139/383 A, 425 A; 28/110, 142
See application file for complete search history.

(56) References Cited

U.S. PATENT DOCUMENTS 1,616,222 A * 2/1927 Harrigan ..... 162/348
4,171,009 A * 10/1979 Karm ..... 139/425 A
4,928,737 A * 5/1990 Borel ..... 139/383 A
4,998,568 A * 3/1991 Vohringer ..... 139/383 A
5,025,839 A 6/1991 Wright
5,456,293 A 10/1995 Ostermayer et al.
5,544,678 A 8/1996 Barrett
5,806,569 A 9/1998 Gulya et al.
5,817,213 A * 10/1998 Ostermayer et al. ..... 162/109
5,839,479 A * 11/1998 Gulya et al. ..... 136/383 A
5,853,547 A * 12/1998 Ahrens et al. ..... 162/348
5,937,914 A 8/1999 Wilson
6,112,774 A 9/2000 Wilson
6,123,116 A 9/2000 Ward et al.
6,592,714 B2 7/2003 Lamb

FOREIGN PATENT DOCUMENTS

WO WO 03/035977 A 5/2003

* cited by examiner

*Primary Examiner*—Eric Hug
(74) *Attorney, Agent, or Firm*—Frommer Lawrence & Haug LLP; Ronald R. Santucci

(57) ABSTRACT

A multi-layer tissue forming fabric constructed so that the top forming surface has topographical differences measured as a plane difference between at least two top weft yarns. The plane difference—the difference in height between the two weft yarns—must be greater than zero. Using at least two different diameter, size, or shape weft yarns positioned at the same contour in the forming surface creates this plane difference and defines pocket areas in the forming surface of the tissue forming fabric. The pocket areas act to generate bulk, cross directional tensile, absorbency, and softness in a formed sheet of tissue, napkin, or towel paper.

38 Claims, 6 Drawing Sheets

Forming Side

Forming Side Impression

TEXTURED SURFACE OF A TISSUE FORMING FABRIC TO GENERATE BULK, CROSS DIRECTIONAL TENSILE, ABSORBENCY, AND SOFTNESS IN A SHEET OF PAPER

BACKGROUND OF THE INVENTION

1. Field of the Invention

The present invention relates to the papermaking arts. More specifically, the present invention relates to forming fabrics for the forming section of a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The properties of absorbency, strength, softness, and aesthetic appearance are important for many products when used for their intended purpose, particularly when the fibrous cellulosic products are facial or toilet tissue, paper towels, sanitary napkins or diapers.

These products can be produced using a variety of processes. Conventional manufacturing machines include a delivery of the suspension of cellulosic fiber onto one or between two forming fabrics. This partially dewatered sheet is then transferred to a press fabric, which dewaters the sheet further as it transfers the sheet to the surface of a large Yankee dryer. The fully dried sheet is either creped or not as it is removed from the Yankee surface and wound onto rolls for further processing.

An alternative process employs a through air drying (TAD) unit either replacing the press fabric above with another woven fabric which transfers the sheet from the forming fabric to the through air drying fabric. It is this fabric which transfers the sheet to a TAD cylinder where hot air is blown through the wet cellulosic sheet, simultaneously drying the sheet and enhancing sheet bulk and softness.

Woven fabrics take many different forms. For example, they may be woven endless, or flat woven and subsequently rendered into endless form with a seam.

The present invention relates specifically to the forming fabrics used in the forming section. Forming fabrics play a critical role during the paper manufacturing process. One of their functions, as implied above, is to form and convey the paper product being manufactured to the press section.

However, forming fabrics also need to address water removal and sheet formation issues. That is, forming fabrics are designed to allow water to pass through (i.e. control the rate of drainage) while at the same time prevent fiber and other solids from passing through with the water. If drainage occurs too rapidly or too slowly, the sheet quality and machine efficiency suffers. To control drainage, the space within the forming fabric for the water to drain, commonly referred to as void volume, must be properly designed.

Contemporary forming fabrics are produced in a wide variety of styles designed to meet the requirements of the paper machines on which they are installed for the paper grades being manufactured. Generally, they comprise a base fabric woven from monofilament and may be single-layered or multi-layered. The yarns are typically extruded from any one of several synthetic polymeric resins, such as polyamide and polyester resins, used for this purpose by those of ordinary skill in the paper machine clothing arts.

The design of forming fabrics additionally involves a compromise between the desired fiber support and fabric stability. A fine mesh fabric may provide the desired paper surface and fiber support properties, but such design may lack the desired stability resulting in a short fabric life. By contrast, coarse mesh fabrics provide stability and long life at the expense of fiber support and the potential for marking. To minimize the design tradeoff and optimize both support and stability, multi-layer fabrics were developed. For example, in double and triple layer fabrics, the forming side is designed for support while the wear side is designed for stability.

Those skilled in the art will appreciate that fabrics are created by weaving, and having a weave pattern which repeats in both the warp or machine direction (MD) and the weft or cross-machine direction (CD). It will also be appreciated that the resulting fabric must be uniform in appearance; that is there are no abrupt changes in the weave pattern to result in undesirable characteristics in the formed paper sheet. Due to the repeating nature of the weave patterns, a common fabric deficiency is a characteristic diagonal pattern in the fabric. In addition, any pattern marking imparted to the formed tissue will impact the characteristics of the paper.

To generate bulk, cross directional tensile, absorbency, and softness in a sheet of paper, a fabric will often be constructed so that the top surface exhibits plane differences between strands. For example, a plane difference is typically measured as the difference in height between two adjacent weft (cross direction) strands in the plane of the forming surface. Bulk, cross directional tensile, absorbency, and softness are particularly important characteristics when producing sheets of tissue, napkin, and towel paper. Hence, tissue forming fabrics preferably exhibit plane differences in the forming side.

One attempt to provide a plane difference is shown in U.S. Pat. No. 5,456,293. The '293 patent shows a single layer TAD fabric wherein the MD yarns are interwoven to produce a zigzag effect. However, as stated in the '293 patent's abstract, the pattern has an array of pockets extending diagonally in alternating fashion across its width. Although the '293 pattern does distribute these pockets, it is preferable to minimize the effects of any discernible pocket patterning.

Additionally, several other patents disclose single layer fabrics having plane differences; e.g. U.S. Pat. No. 5,806,569, U.S. Pat. No. 5,839,478, and U.S. Pat. No. 5,853,547. While all of these patents describe fabrics exhibiting a plane difference in the forming side, their single layer designs do not allow for the optimized balance between support and stability that multi-layer fabrics can provide.

Therefore, a need exists for a tissue forming fabric having a plane difference in the forming side to generate bulk, cross directional tensile, absorbency, and softness in the tissue paper while minimizing the adverse effects of a strongly defined diagonal pocket pattern.

A further need exists for such a fabric to provide more cross-directional stability and stiffness to prevent cross directional fabric shrinkage, improve sheet formation and appearance, and potentially increase life.

The present invention is a multi-layer tissue forming fabric having different diameter, size, or shape weft strands to produce a plane difference on the forming side. The present invention provides a solution to the problems of providing a fabric pattern having a plane difference while maintaining good sheet fiber support and fabric stability properties.

SUMMARY OF THE INVENTION

Accordingly, the present invention is a multi-layer forming fabric, although it may find application in the forming, pressing and drying sections of a paper machine.

The present invention is a multi-layer fabric having a plane difference in the forming surface while maintaining good sheet fiber support and fabric stability properties. To obtain these characteristics, the fabric uses at least two different diameter, size, or shape weft strands positioned in the same contour in the forming surface to create a forming side plane difference in the tissue forming fabric. This plane difference in the forming surface generates bulk, cross directional tensile, absorbency, and softness in a sheet of tissue paper formed by the fabric.

A first embodiment of the invention is a multi-layer forming fabric for use in producing tissue, napkin, and towel paper. The fabric comprises a top layer of cross-machine direction (CD) wefts, a bottom layer of CD wefts, and a system of machine-direction (MD) yarns interwoven with the top and bottom layers of CD wefts. The top layer has at least two different diameter, size, or shapes of weft yarns that are positioned at the same contour in the layer to produce a plane difference in the forming surface of the fabric. This plane difference in the forming surface generates bulk, cross directional tensile, absorbency, and softness in a sheet of tissue paper formed by the fabric. The top layer of CD yarns forms the forming side of the fabric and the bottom layer of CD yarns forms the wear side of the fabric. The top layer produces a forming surface impression that significantly reduces the typical problems caused by pocket patterning.

Preferably, in this embodiment of the fabric, each MD yarn weaves in the top layer over a small diameter CD weft yarn, under an adjacent large diameter CD weft yarn and the next small CD weft yarn, and over the next large CD weft yarn before crossing to weave in pattern with the bottom layer. The CD weft yarns in the top layer may be vertically stacked with the CD weft yarns in the bottom layer.

The present invention may also include a middle layer of CD weft yarns between the top layer and bottom layer and being interwoven with the system of MD yarns. Alternatively, these middle layer CD weft yarns may be vertically stacked with the CD weft yarns in the bottom layer to form a TSS (triple stacked shute double layer) fabric. Note the terms "shute" and "weft" are interchangeable in this context.

Another embodiment of the invention is a papermaker's fabric comprising a top layer of weft yarns having at least two different diameters, sizes, or shapes positioned at the same contour and interwoven with a system of warp yarns, and a bottom layer of weft yarns interwoven with the system of warp yarns. The weft yarns and warp yarns define pocket areas in the surface of the top layer. The top layer has at least three levels produced by plane differences between the largest diameter weft yarn and the warp yarns. These levels define pocket depths corresponding to the pocket areas.

Still another embodiment of the invention is a papermaker's fabric comprising a top layer of weft yarns having at least three different diameters, sizes, or shapes positioned at the same contour and interwoven with a system of warp yarns; a bottom layer of weft yarns interwoven with the system of warp yarns; and binder weft yarns for binding the top layer and bottom layer together to form the fabric. The weft yarns which have the larger two diameters and the warp yarns define macro-pocket areas in the surface of the top layer. The weft yarns which have the smallest diameter, the binder weft yarns, and the warp yarns define micro-pocket areas in the surface of the top layer. The top layer has at least three levels produced by plane differences between the largest diameter weft yarns and the warp yarns. These levels define pocket depths corresponding to the macro-pocket areas and micro-pocket areas.

Other aspects of the present invention include that the MD yarns and CD wefts are preferably monofilament yarns. Also, at least some of the MD yarns and some of the CD weft yarns are preferably one of polyester, polyamide or other polymeric materials known to those skilled in the art of forming fabrics. The MD yarns and CD wefts may have a circular cross-sectional shape, a rectangular cross-sectional shape or a non-round cross-sectional shape. When the yarn is of a non-round cross section, for example rectangular, it will usually be woven such that the larger dimension (MD/CD aspect ratio in the CD dimension is larger) is always oriented the same, that is, the yarn is not twisted. In one aspect of the invention, the yarn is allowed to twist as it is woven and the twist adds a random appearance to the fabric. In other words, the twisted yarns produce a textured fabric which results in a random marking pattern.

The present invention will now be described in more complete detail with frequent reference being made to the drawing figures, which are identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

Figure 1:
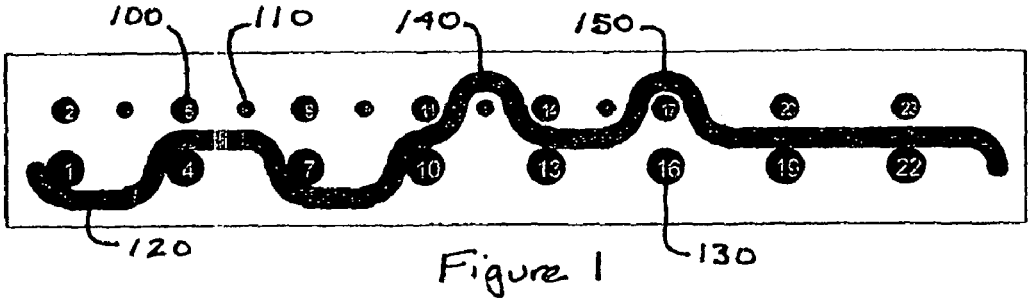
FIG. 1 is a schematic cross-sectional view in the CD of a fabric pattern in accordance with the teachings of the present invention.

FIG. 1 is a schematic cross-sectional view in the CD of an example fabric pattern in accordance with the teachings of the present invention. As shown, the present invention is a multi-layer tissue forming fabric constructed so that the top forming surface has topographical differences measured as a plane difference between two top weft yarns. The plane difference—the difference in height between two adjacent weft yarns—must be greater than zero. The present invention uses at least two different diameter CD weft yarns 100, 110 and positions them on the same contour in the forming surface to create the forming side plane difference in the tissue forming fabric. The plane difference in the forming surface generates bulk, cross directional tensile, absorbency, and softness in a sheet of tissue, napkin, or towel paper. The present invention is preferably a double layer or triple stacked shute (TSS) double layer fabric. However, the present invention is applicable to any multi-layer fabric style including double layer, double layer support (stacked) shute (DLSS), TSS and triple layer fabrics.

In the preferred embodiment, shown in FIG. 1, each MD yarn 120 passes over a smaller weft 140 in the forming side, under the adjacent larger weft yarn and the next smaller weft yarn, and over the next larger weft yarn 150 before crossing to the bottom layer where it weaves in pattern with the bottom layer CD weft yarns 130.

Figure 2:
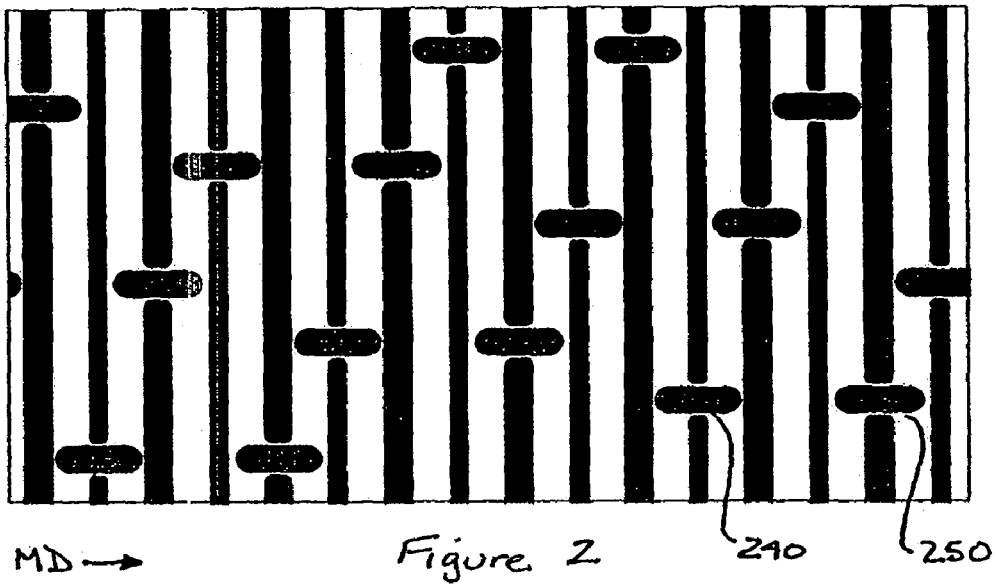
FIG. 2 is a schematic forming side (top) view of a fabric woven in accordance with the teachings of the present invention.

FIG. 2 is a schematic forming side (top) view of the fabric shown in FIG. 1. Note the machine direction is horizontal. As in FIG. 1, each MD yarn passes over a smaller weft yarn 240 in the forming side, under the adjacent larger weft yarn and the next smaller weft yarn, and over the next larger weft yarn 250 before crossing to the bottom layer. The MD yarns are staggered as shown and repeat in pattern every eighth yarn. The pattern shown is merely one embodiment of the invention. The invention should not be construed as being limited to this example pattern.

Figure 3:
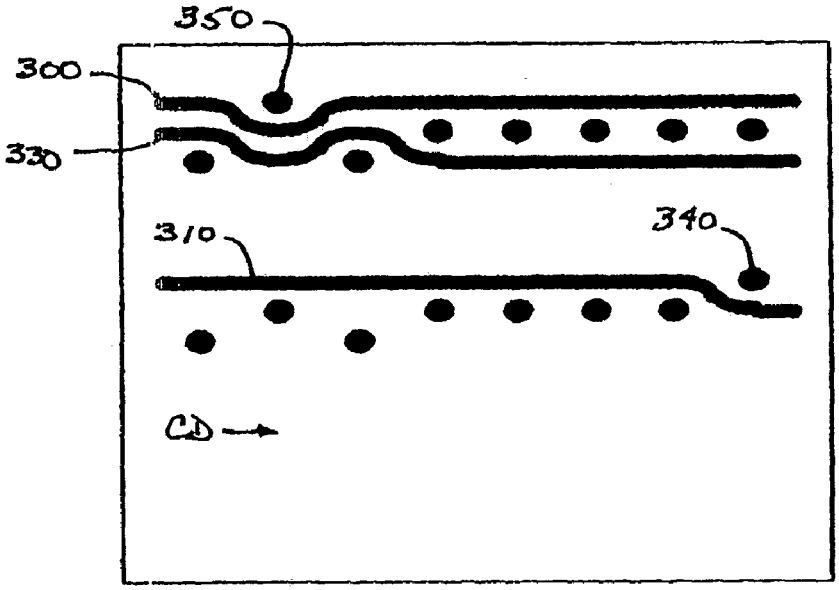
FIG. 3 shows two schematic cross-sectional views in the MD of a fabric pattern in accordance with the teachings of the present invention.

FIG. 3 shows two schematic cross-sectional views in the MD of a fabric pattern in accordance with the teachings of the present invention. The top view shows the larger diameter top CD weft yarn 300, which is vertically stacked over the bottom layer CD weft yarn 330. In one complete pattern, a single MD yarn 350 passes over both the CD weft yarns at one location. This knuckle 350 corresponds to knuckle 150 in FIG. 1 and knuckle 250 in FIG. 2. The bottom view in FIG. 3 shows the smaller diameter top CD weft yarn 310. In one complete pattern, a single MD yarn 340 passes over the small CD weft yarn 310 at one location. This knuckle 340 corresponds to knuckle 140 in FIG. 1 and knuckle 240 in FIG. 2. Again, the invention should not be construed as being limited to the example pattern shown.

Figure 4:
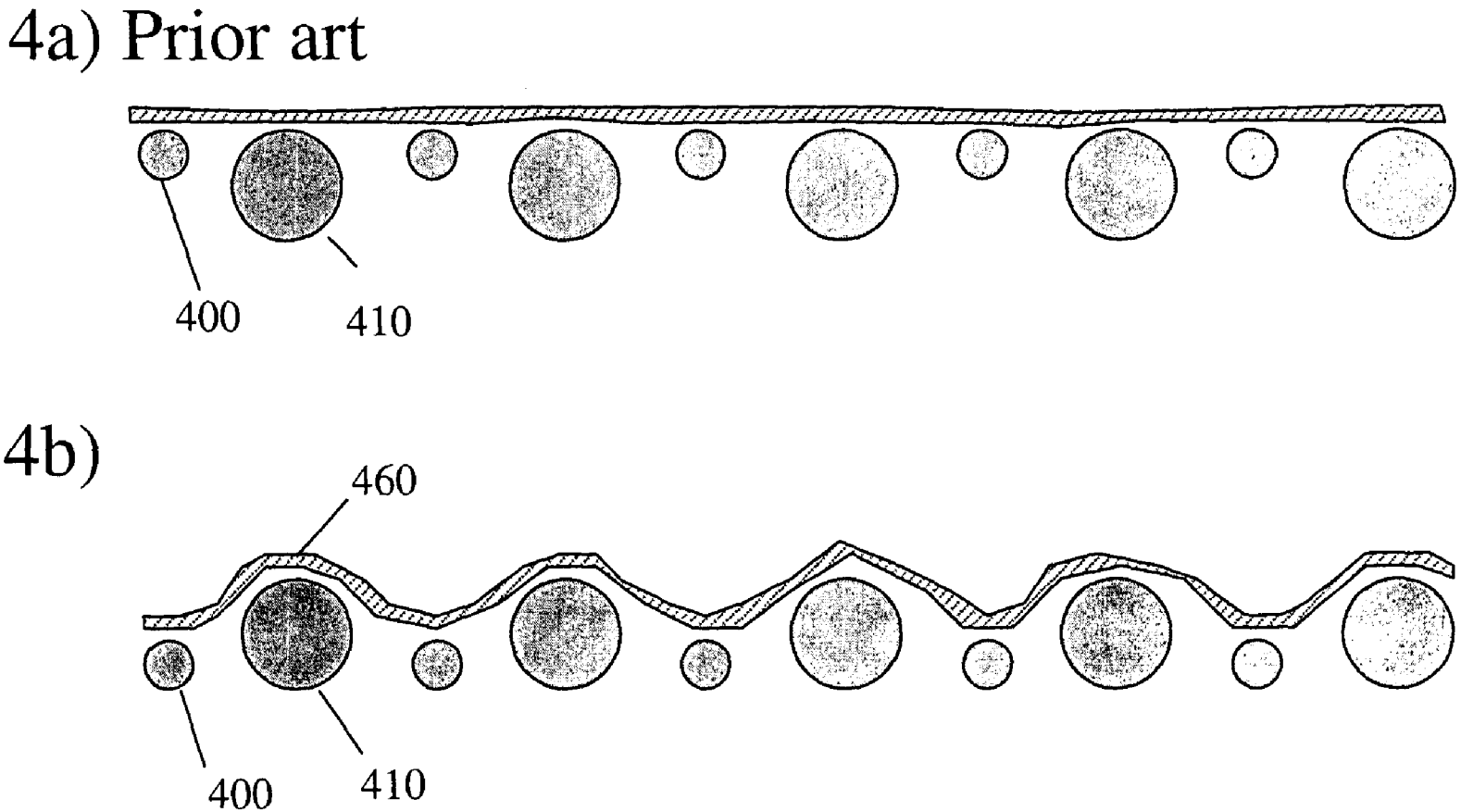
FIG. 4 shows the formation of a tissue paper across the different sized CD yarns of a fabric pattern in accordance with the teachings of: a) the prior art and b) the present invention.

FIG. 4 shows an exaggerated schematic cross-sectional view in the CD of the top layer of an example fabric pattern in accordance with the teachings of: 4*a*) the prior art and 4*b*) the present invention. View 4*b* illustrates the formation of a tissue paper 460 formed by the plane difference in the forming surface of the fabric produced by two different sized CD weft yarns 400, 410 positioned in the same contour. By contrast, in prior art view 4*a*, the two different sized CD weft yarns 400, 410 are positioned in different contours such that they align in the same plane to produce a uniform forming surface. As discussed previously, a plane difference in the forming surface generates bulk, cross directional tensile, absorbency, and softness in a sheet of tissue, napkin, or towel paper.

Figure 5:
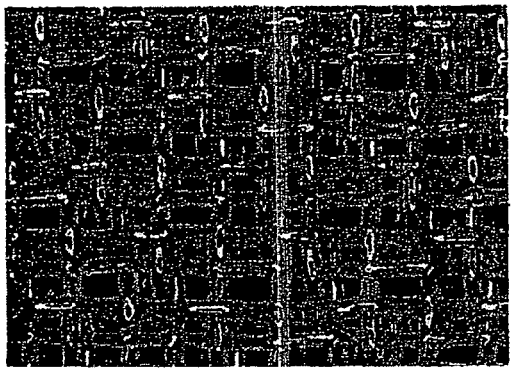
FIG. 5 is a forming side view and a forming side impression of a fabric woven in accordance with the teachings of the present invention.
Figure 5:
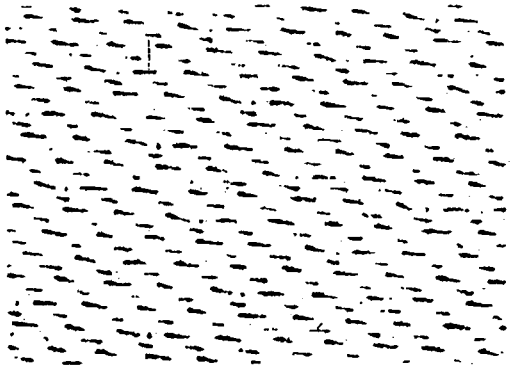

FIG. 5 is a forming side view of a fabric woven in accordance with the teachings of the present invention and a forming side impression made from the fabric Importantly, the imprint of the fabric shows defined pockets minimizing diagonal patterning. This is an advantage of the present invention's fabric pattern over prior art tissue forming fabrics.

The present invention may also be characterized by pocket areas defined by the yarn pattern in the textured forming surface of the fabric. By aligning different size weft yarns at the same contour in the fabric layer, and by choosing the proper weave pattern, the pocket depth, area and volume can be maximized. In addition, more than two yarn diameters, sizes, or shapes may be used to define pockets having multiple depth levels and sizes. These pockets may alternatively be described as multiple frames in the forming surface having varying sizes and depths.

A multi-level pocket depth and size results in a less defined macro surface. This embodiment of the present invention incorporates multiple levels of (weft induced) texture with the goal of generating variable levels and sizes of micro-pockets in the forming surface of the fabric which may contribute to the overall bulk of a formed tissue, napkin, or towel sheet. This also enhances the absorptive capacity while maintaining CD tensile and softness in the tissue sheet of paper.

In another embodiment of the invention, the paperside surface of the tissue forming fabric is constructed in such a way that the top surface has topographical differences of three or more levels (as measured by plane differences between each top weft yarn and the adjacent warp yarns). The (square area of the) pockets are defined by choosing a reference warp yarn and a reference weft yarn and finding the furthest adjacent weft yarn that defines a pocket area.

Figure 6:
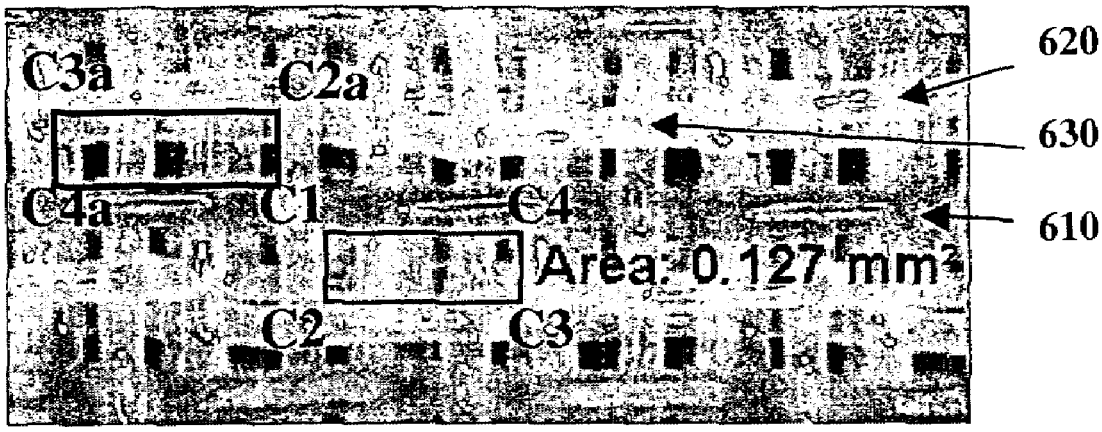
FIG. 6 is a forming side view showing defined pocket areas in accordance with the teachings of the present invention.

FIG. 6 is a forming side view showing defined pocket areas in accordance with the teachings of the present invention. In FIG. 6, rectangles have been superimposed to outline the pocket areas. To define the boundaries of the pocket areas, a reference warp yarn knuckle C1 is first selected.

From this reference knuckle C1, the warp yarn is traced in the machine direction (up and down in the picture) until the first adjacent weft yarn float is reached (points C2 and C2*a*). Then, moving in the cross machine direction, this weft yarn is traced until another warp yarn knuckle appears (points C3 and C3*a*) in the direction which yields the larger pocket area. Hence, from point C2 the longest non-broken weft yarn float moves from left to right and from point C2*a* the longest non-broken weft yarn float moves right to left. The border of the pockets then move along the longest non-broken weft yarn until the next adjacent warp yarn knuckle is reached, i.e. points C3 and C3*a*. From points C3 and C3*a*, the borders of the pockets are traced in the opposite direction of travel between points C1 and C2 (or C1 and C2*a*), until the nearest adjacent weft yarn float is reached (points C4 and C4*a*). The pockets are enclosed by forming a line connecting points C4 or C4*a* with reference point C1. As shown, the top pocket area is predominantly defined by weft yarns 610, 620 and 630.

In addition to the surface area of the pocket, the pocket depth may be optimized. The combination of the pocket area and pocket depth defines the pocket volume. Due to the inherent woven nature of the fabric, each defined pocket will have one or more warp yarns located at specific depths below the plane of the fabric surface. It is preferable to have the predominant warp yarns in the pocket at the same plane and to have these predominant warp yarns be as deep as possible beneath the surface of the fabric. This provides the pocket with a large volume.

Figure 7:
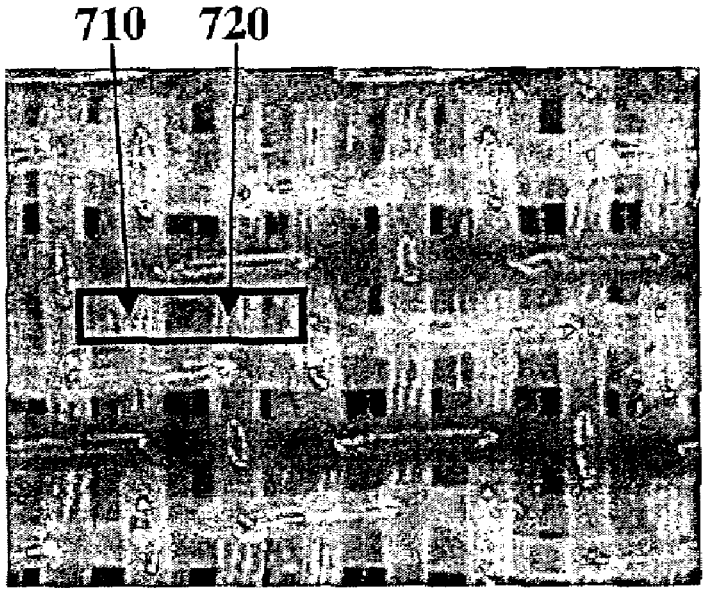
FIG. 7 is a forming side view showing the predominant warp yarns within a pocket area in accordance with the teachings of the present invention.

FIG. 7 is a forming side view showing the predominant warp yarns within a pocket. As shown, the superimposed rectangle corresponds to the border of a pocket area. Within this pocket are two predominant warp yarns 710 and 720. By optimizing the pocket volume (by controlling the pocket size and depth), the properties of the formed tissue, napkin, or towel sheets can be enhanced.

Figure 10:
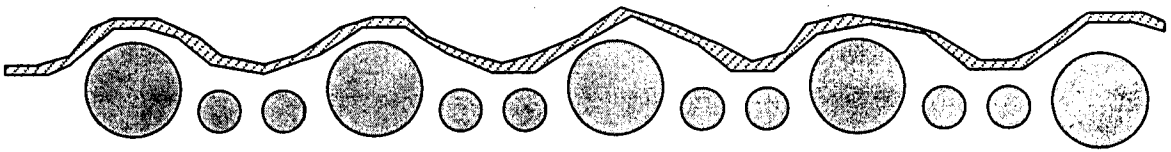
FIG. 10 shows the formation of a tissue paper across the different sized CD yarns of a fabric pattern corresponding to those shown in FIGS. 6 and 7.

FIG. 10 shows the formation of a tissue paper across the different sized CD yarns of a fabric pattern corresponding to those shown in FIGS. 6 and 7. This view is analogous to view 4*b* of FIG. 4 and can be contrasted with the prior art shown in view 4*a*.

Figure 8:
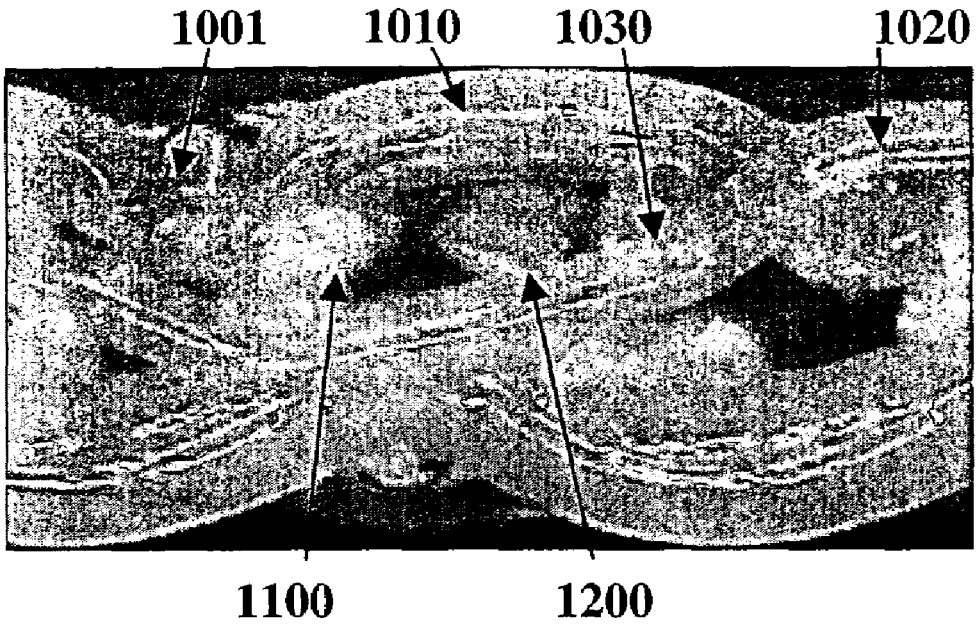
FIG. 8 is a cross-sectional view in the MD of a fabric in accordance with the teachings of the present invention.

FIG. 8 is a cross-sectional view in the MD of a fabric wherein the predominant warp yarns 1100 and 1200 are in the same contour a predetermined distance below the surface of the fabric. The reference knuckle 1001 for this pocket area is similar to the reference knuckle C1 shown in FIG. 6. Surface weft yarn float 1010 is the long non-broken weft yarn float on the forming surface. By increasing the diameter of weft yarn 1010, the vertical distance between the top of the weft yarn and the bottom of the pocket can be increased. However, if the diameter of weft yarn 1010 is increased too much, the thickness of the weft yarn begins to reduce the area of the pocket; thereby offsetting any gains from the pocket depth.

A significantly large weft yarn 1010 may also distort the overall weave pattern. One method of avoiding or minimizing such distortion is to vary the properties of the yarns used. For example, polymeric monofilaments may be produced from hard or soft materials. A soft weft material will flex around the warps more easily, thus providing a higher knuckle than a harder weft material. In this case, a softer monofilament can be used to further optimize the pocket depth without distorting the weave pattern.

Figure 9:
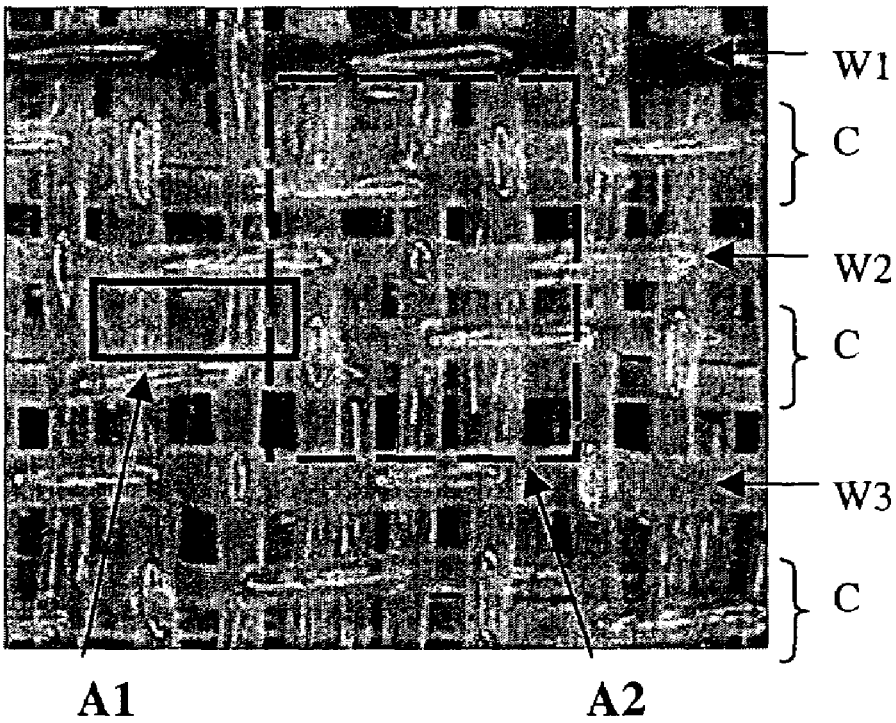
FIG. 9 is a forming side view showing defined micro and macro pocket areas in accordance with the teachings of the present invention.

Another aspect of the present invention is that micro and macro pockets can be defined by the choice of weave pattern. In such a case, both the micro and macro pockets can act to enhance the surface topography and formed tissue sheet characteristics. FIG. 9 is a forming side view of another embodiment of the present invention having defined micro and macro pocket areas. In this embodiment, differing diameter wefts are used to create both micro and macro topographical imprints.

As shown in FIG. 9, the present fabric includes forming weft yarns W1, W2, and W3; binder yarn groups C; micro pockets A1; and macro pockets A2. The forming weft yarns W1, W2 and W3 preferably have different diameters while the yarns in the binder groups C have the same diameter as forming weft yarn W2. This arrangement of forming and binder weft yarns produce micro pockets A1 which are similar to the pocket area described in FIG. 6. This arrangement also produces macro pockets A2 having a significantly larger surface area than the micro pockets. Due to this surface area difference, the macro pockets will effect the final sheet surface differently than the micro pockets. For example, the micro pockets are small enough to impact the small length fibers used in sheet formation while the macro pockets may impact the longer fibers used in sheet formation. Unlike the micro pockets, it is the plane difference between the largest diameter or size weft yarn and the smallest diameter or size weft yarn that determines the depth of the macro pockets. Also note that each macro pocket may contain several micro pockets. This feature acts to blend the effects of each pocket type.

Figure 11:
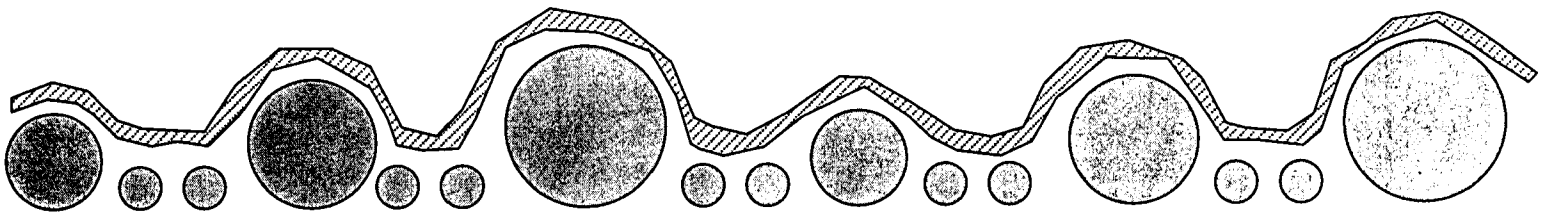
FIG. 11 shows the formation of a tissue paper across the different sized CD yarns of a fabric pattern corresponding to those shown in FIGS. 8 and 9.
Figure 12:
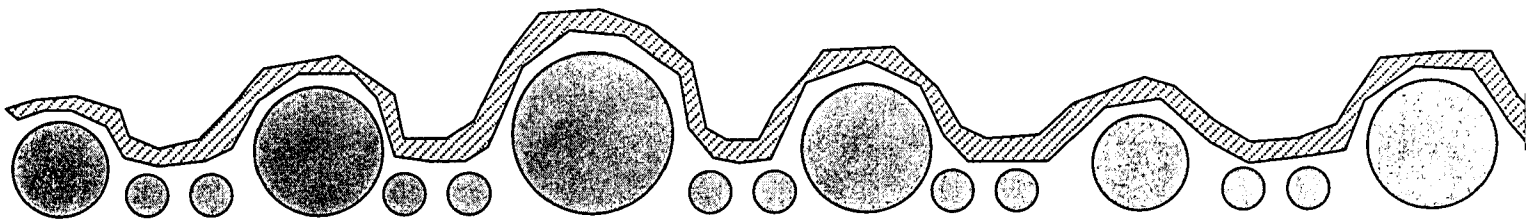
FIG. 12 shows the formation of a tissue paper across the different sized CD yarns of another fabric pattern corresponding to those shown in FIGS. 8 and 9.

FIGS. 11 and 12 show the formation of a tissue paper across the different sized CD yarns of two exemplary fabric patterns, each corresponding to the fabrics shown in FIGS. 8 and 9. Again, these figures are analogous to view 4*b* of FIG. 4 and can be compared with the prior art shown in view 4*a*.

As mentioned above, although the examples shown in the figures are triple layer fabrics, the invention is not limited as such. As will be appreciated by one skilled in the art, the present multi-layered fabric can be a double layer, double layer support shute, triple layer with conventional CD binder, triple layer with paired CD binders, triple layer with conventional warp binder, triple layer with paired warp binders, and any other suitable type of multi-layer fabric weave patterns.

Further, in the present forming fabrics, the top layer and bottom layer of each fabric may be bound together by binder weft yarns, binder warp yarns, or integral warp or weft binders.

The fabric according to the present invention preferably comprises only monofilament yarns. Specifically, the yarns may be polyester, polyamide or other polymeric monofilament. The CD and MD yarns may have a circular cross-sectional shape with one or more different diameters. Further, in addition to a circular cross-sectional shape, one or more of the yarns may have other cross-sectional shapes such as a rectangular cross-sectional shape or a non-round cross-sectional shape.

Modifications to the above would be obvious to those of ordinary skill in the art, but would not bring the invention so modified beyond the scope of the present invention. The claims to follow should be construed to cover such situations.

What is claimed is:

1. A papermaker's fabric comprising:

a top layer of cross-machine direction (CD) weft yarns; the top layer having at least two different diameter, size, or shape weft yarns in a same contour to produce a plane difference in the forming surface of the fabric;

a bottom layer of CD weft yarns; and a system of machine-direction (MD) warp yarns interwoven with the top and bottom layers of CD weft yarns;

wherein said top layer of CD weft yarns form floats longer than those of MD warp yarns on the forming surface of the fabric;

wherein the top layer produces a forming surface impression with a preferred pocket marking pattern.

2. The papermaker's fabric according to claim 1, wherein the top layer of CD weft yarns forms a forming side of the fabric and the bottom layer of CD weft yarns forms a wear side of the fabric.

3. The papermaker's fabric according to claim 1, wherein the fabric is a forming fabric for producing tissue, napkin, and towel paper.

4. The papermaker's fabric according to claim 1, wherein the plane difference in the top layer generates bulk, cross directional tensile, absorbency, and softness in a sheet of paper formed by the fabric.

5. The papermaker's fabric according to claim 1, wherein the MD yarns and CD weft yarns are monofilament yarns.

6. The papermaker's fabric according to claim 1, wherein at least some of the MD yarns are one of polyester yarns, polyamide yarns, or other polymeric yarns.

7. The papermaker's fabric according to claim 1, wherein at least some of the CD weft yarns are one of polyester yarns, polyamide yarns, or other polymeric yarns.

8. The papermaker's fabric according to claim 1, wherein at least some of the yarns are one of hard or soft material yarns.

9. The papermaker's fabric according to claim 1, wherein the MD warp yarns and/or CD weft yarns have a circular cross-sectional shape, a rectangular cross-sectional shape or a non-round cross-sectional shape.

10. The papermaker's fabric according to claim 1, wherein the fabric is a double layer or double layer support shute fabric.

11. The papermaker's fabric according to claim 1, wherein the at least two different diameter, size, or shape weft yarns alternate in the top layer.

12. A papermaker's fabric comprising:

a top layer of cross-machine direction (CD) weft yarns; the top layer having at least two different diameter, size, or shape weft yarns in a same contour to produce a plane difference in the forming surface of the fabric;

a bottom layer of CD weft yarns;

a system of machine-direction (MD) warp yarns interwoven with the top and bottom layers of CD weft yarns; and a middle layer of CD weft yarns between the top layer and bottom layer and being interwoven with the system of MD yarns; and wherein the top layer produces a forming surface impression with a preferred pocket marking pattern.

13. The papermaker's fabric according to claim 12, wherein the CD weft yarns in the middle layer are vertically stacked with the CD weft yarns in the bottom layer.

14. The papermaker's fabric according to claim 13, wherein the fabric is a triple stacked shute (TSS) fabric.

15. A papermaker's fabric comprising:

a top layer comprised of weft yarns of at least two different diameters, sizes, or shapes in a same contour interwoven with a system of warp yarns; and a bottom layer of weft yarns interwoven with the system of warp yarns; the weft yarns and warp yarns defining pocket areas in the surface of the top layer; the top layer having at least three levels produced by plane differences between a largest diameter, size, or shape weft yarn and the warp yarns; the levels defining pocket depths corresponding to the pocket areas; wherein said top layer weft yarns form floats longer than those of warp yarns on the forming surface of the fabric.

16. The papermaker's fabric according to claim 15, wherein the top layer forms a forming side of the fabric and the bottom layer forms a wear side of the fabric.

17. The papermaker's fabric according to claim 15, wherein the fabric is a forming fabric for producing tissue, napkin, and towel paper.

18. The papermaker's fabric according to claim 15, wherein the pocket areas and corresponding pocket depths in the top layer generates bulk, cross directional tensile, absorbency, and softness in a sheet of paper formed by the fabric.

19. The papermaker's fabric according to claim 15, wherein the weft yarns and warp yarns are monofilaments.

20. The papermaker's fabric according to claim 15, wherein the weft yarns and warp yarns are one of polyester yarns, polyamide yarns, or other polymeric yarns.

21. The papermaker's fabric according to claim 15, wherein at least some of the yarns are one of hard or soft material yarns.

22. The papermaker's fabric according to claim 15, wherein the weft yarns and warp yarns have a circular cross-sectional shape, a rectangular cross-sectional shape or a non-round cross-sectional shape.

23. A papermaker's fabric comprising: a top layer comprised of weft yarns of at least three different diameters, sizes, or shapes at a same contour interwoven with a system of warp yarns; a bottom layer of weft yarns interwoven with the system of warp yarns; and binder weft yarns, binder warp yarns, or integral warp or weft binders for binding the top layer and bottom layer together to form the fabric; the weft yarns having the larger two diameters, sizes, or shapes and the warp yarns defining macro-pocket areas in the surface of the top layer; the weft yarns having the smallest diameter, the binder weft yarns, and the warp yarns defining micro-pocket areas in the surface of the top layer; the top layer having at least three levels produced by plane differences between the largest diameter weft yarns and the warp yarns; the levels defining pocket depths corresponding to the macro-pocket areas and micro-pocket areas.

24. The papermaker's fabric according to claim 23, wherein the top layer forms a forming side of the fabric and the bottom layer forms a wear side of the fabric.

25. The papermaker's fabric according to claim 23, wherein the fabric is a forming fabric for producing tissue, napkin, and towel paper.

26. The papermaker's fabric according to claim 23, wherein the macro-pocket areas and micro-pocket areas in the top layer combine to generate bulk, cross directional tensile, absorbency, and softness in a sheet of paper formed by the fabric.

27. The papermaker's fabric according to claim 23, wherein each pocket area includes at least two predominant warp yarns at the same level.

28. The papermaker's fabric according to claim 23, wherein the weft yarns, warp yarns, and binder yarns are monofilaments.

29. The papermaker's fabric according to claim 23, wherein the weft yarns and warp yarns have a circular cross-sectional shape, a rectangular cross-sectional shape or a non-round cross-sectional shape.

30. The papermaker's fabric according to claim 29, wherein the rectangular cross-sectional shape yarns or non-round cross-sectional shape yarns are twisted.

31. The papermaker's fabric according to claim 23, further comprising a middle layer of weft yarns between the top layer and bottom layer and being interwoven with the system of warp yarns.

32. The papermaker's fabric according to claim 23, wherein at least some of the CD weft yarns are one of polyester yarns, polyamide yarns, or other polymeric yarns.

33. The papermaker's fabric according to claim 23, wherein at least some of the yarns are one of hard or soft material yarns.

34. A papermaker's fabric comprising:

a top layer of cross-machine direction (CD) weft yarns; the top layer having at least two different diameter, size, or shape weft yarns in a same contour to produce a plane difference in the forming surface of the fabric;

a bottom layer of CD weft yarns; and a system of machine-direction (MD) warp yarns interwoven with the top and bottom layers of CD weft yarns, wherein each MD yarn weaves in the top layer over a small diameter CD weft yarn, under an adjacent large diameter CD weft yarn and the next small diameter CD weft yarn, and over the next large diameter CD weft yarn before crossing to weave in pattern with the bottom layer; and wherein the top layer produces a forming surface impression with a preferred pocket marking pattern.

35. A papermaker's fabric comprising:

a top layer of cross-machine direction (CD) weft yarns; the top layer having at least two different diameter, size, or shape weft yarns in a same contour to produce a plane difference in the forming surface of the fabric;

a bottom layer of CD weft yarns; and a system of machine-direction (MD) warp yarns interwoven with the top and bottom layers of CD weft yarns;

wherein said top layer of CD weft yarns form long floats on the forming surface of the fabric;

wherein the top layer produces a forming surface impression with a preferred pocket marking pattern; and wherein the MD warp yarns and/or CD weft yarns have a circular cross-sectional shape, a rectangular cross-sectional shape or a non-round cross-sectional shape, said rectangular cross-sectional shaped yarns and said non-round cross-sectional shaped yarns being twisted yarns.

36. A papermaker's fabric comprising:

a top layer comprised of weft yarns of at least two different diameters, sizes, or shapes in a same contour interwoven with a system of warp yarns; and a bottom layer of weft yarns interwoven with the system of warp yarns; the weft yarns and warp yarns defining pocket areas in the surface of the top layer; the top layer having at least three levels produced by plane differences between a largest diameter, size, or shape weft yarn and the warp yarns; the levels defining pocket depths corresponding to the pocket areas; wherein each pocket area includes at least two predominant warp yarns at the same level; and wherein said top layer weft yarns form long floats on the forming surface of the fabric.

37. A papermaker's fabric comprising:

a top layer comprised of weft yarns of at least two different diameters, sizes, or shapes in a same contour interwoven with a system of warp yarns; and a bottom layer of weft yarns interwoven with the system of warp yarns; the weft yarns and warp yarns defining pocket areas in the surface of the top layer; the top layer having at least three levels produced by plane differences between a largest diameter, size, or shape weft yarn and the warp yarns; the levels defining pocket depths corresponding to the pocket areas; and wherein the weft yarns and warp yarns have a circular cross-sectional shape, a rectangular cross-sectional shape or a non-round cross-sectional shape, said rectangular cross-sectional shaped yarns and said non-round cross-sectional shaped yarns being twisted yarns.

38. A papermaker's fabric comprising:

a top layer comprised of weft yarns of at least two different diameters, sizes, or shapes in a same contour interwoven with a system of warp yarns;

a bottom layer of weft yarns interwoven with the system of warp yarns; and a middle layer of weft yarns between the top layer and bottom layer and being interwoven with the system of warp yarns; the weft yarns and warp yarns defining pocket areas in the surface of the top layer; the top layer having at least three levels produced by plane differences between a largest diameter, size, or shape weft yarn and the warp yarns; the levels defining pocket depths corresponding to the pocket areas; wherein said top layer weft yarns form long floats on the forming surface of the fabric.

* * * * *